US006796364B1

(12) United States Patent
Jacobsen

(10) Patent No.: US 6,796,364 B1
(45) Date of Patent: Sep. 28, 2004

(54) INDEPENDENT CONTROL OF SQUEEZE PLATE VELOCITY DURING FLASKLESS MOULDING

(75) Inventor: Ole Anders Jacobsen, Tisvildeleje (DK)

(73) Assignee: DISA Industries A/S, Herlev (DK)

( * ) Notice: Subject to any disclaimer, the term of this patent is extended or adjusted under 35 U.S.C. 154(b) by 0 days.

(21) Appl. No.: 10/049,676

(22) PCT Filed: Aug. 16, 1999

(86) PCT No.: PCT/DK99/00437

§ 371 (c)(1),
(2), (4) Date: Feb. 15, 2002

(87) PCT Pub. No.: WO01/12360

PCT Pub. Date: Feb. 22, 2001

(51) Int. Cl.[7] ..... B22C 15/02; B22C 25/00

(52) U.S. Cl. ..... 164/456; 164/18; 164/40; 164/187; 164/323

(58) Field of Search ..... 164/151.1, 456, 164/18, 40, 322, 323, 187

(56) References Cited

U.S. PATENT DOCUMENTS 5,647,424 A * 7/1997 Larsen et al. ..... 164/18
6,502,620 B1 * 1/2003 Jacobsen et al. ..... 164/18

* cited by examiner

*Primary Examiner*—Kuang Y. Lin
(74) *Attorney, Agent, or Firm*—Stites & Harbison PLLC; Douglas E. Jackson

(57) ABSTRACT

The present invention relates to a method of producing mold parts (5) on a string molding apparatus comprising a molding chamber (1) between a squeeze plate (2) and a pivoted squeeze plate (3) in which both the squeeze plate (2) and the pivoted squeeze plate (3) can move in a direction towards each other and a direction away from one another comprising the steps of introducing a compressible particulate molding material (4) in the molding chamber (1) and then squeezing the molding material (4) by moving the squeeze plate (2) and the pivoted squeeze (3) towards one another wherein the velocity of the squeeze plate and the velocity of the pivoted squeeze plate are controlled independent from one another during the squeezing of the mold part (5). Further the invention relates to a string molding apparatus for producing mold parts (5) comprising a molding chamber (1) between a squeeze plate (2) and a pivoted squeeze plate (3), in which mold parts (5) are produced by introducing a compressible particulate molding material (4) in the molding chamber (1) and then moving the squeeze plate (2) and the pivoted squeeze plate (3) towards each other to squeeze the mold part (5) wherein the velocity of the squeeze plate (2) and the velocity of the pivoted squeeze plate (3) are controlled independently from one another during squeezing of the mold part (5).

19 Claims, 6 Drawing Sheets

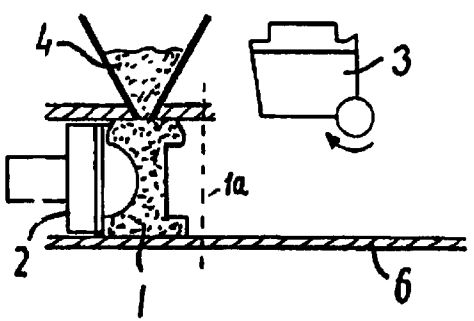
FIG. 1
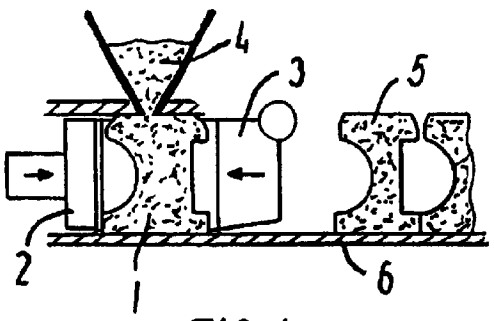
FIG. 1a
FIG. 1b
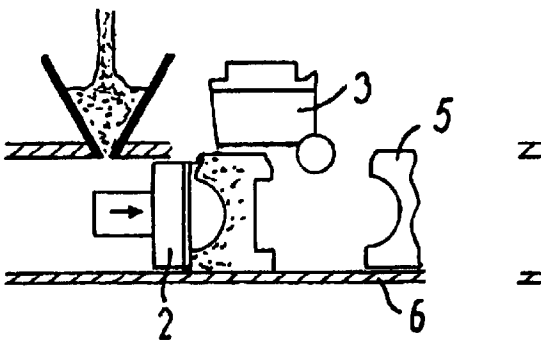
FIG. 1c
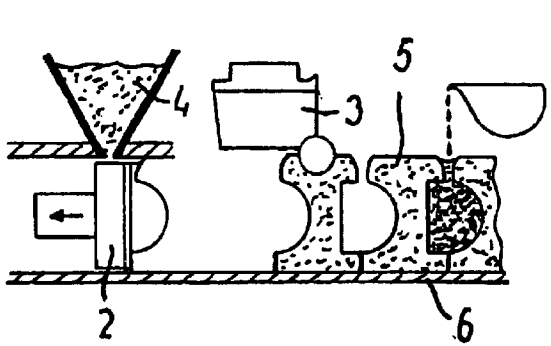
FIG. 1d
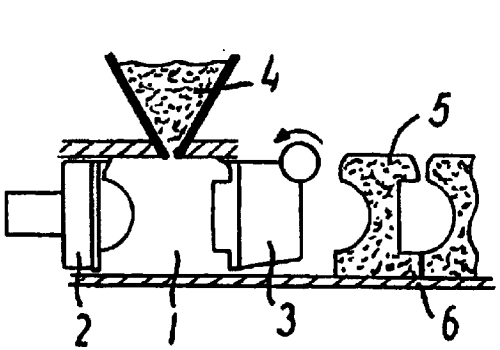
FIG. 1e

INDEPENDENT CONTROL OF SQUEEZE PLATE VELOCITY DURING FLASKLESS MOULDING

TECHNICAL FIELD

The present invention relates to a method of producing mould parts on a mould string apparatus and to a string moulding apparatus for producing mould parts, in which the mould parts are produced by introducing a compressible particulate moulding material in the moulding chamber and then moving a squeeze plate and a pivoted squeeze plate towards each other to squeeze the mould part.

BACKGROUND ART

A method and apparatus of this general kind is known from U.S. Pat No. 5,647,424. According to this method, an apparatus comprising a moulding chamber between a squeeze plate and a pivoted squeeze plate carries out a number of sequential movements in order to produce a mould part The moulding process comprises the steps of:

- charging the moulding chamber with compressible mould material, e.g. clay-bonded green sand,
- bilateral pressing the mould material between a squeeze plate and a pivoted squeeze plate thus forming a mould part,
- retracting the pivoted squeeze plate and pivoting the pivoted squeeze plate out of the way,
- moving the squeeze plate towards and past the pivoted squeeze plate for pushing the mould out from the moulding chamber and bringing it into abutment with a mould having been produced immediately before, and
- moving the squeeze plates back to their respective starting positions, after which a new cycle begins.

The squeezing of the mould process according to U.S. Pat. No. 5,647,424 is bilateral, i.e. both the squeeze plate and the pivoted squeeze plate move into the moulding chamber during the squeezing of the mould. The advantage of bilateral squeezing is the in the degree of compaction of the sand and the squeeze plate and the pivoted squeeze plate is equal, hence the degree of hardness of the mould surfaces produced at these plates is equal. However, often the squeezed mould part will not be placed at the moulding chamber front at the end of the squeezing process. This has the disadvantage that a vacuum will be drawn when the pivoted squeeze plate is stripped from the mould part and retracted from the moulding chamber. The vacuum can damage the mould part or reduce the quality of the mould part by tearing off pieces of the mould part and by sucking in sand which deposits on the surface of the mould part.

This problem has up to now been solved by moving the pivoted squeeze plate so slowly out of the moulding chamber that the vacuum is reduced by air flowing in through nozzles and openings between the pivoted squeeze plate an the moulding chamber. Another solution has been to move the squeeze plate and the pivoted squeeze plate simultaneously and with the same speed towards the front of the moulding chamber after the squeezing process so that the mould part is transported to the chamber front. Both solutions have the disadvantage that the cycle time is significantly increased.

DISCLOSURE OF THE INVENTION

It is the object of the invention to provide a method of producing mould parts on a mould string apparatus of the kind referred to above, in which the bilateral squeezing process can be controlled in a better way. By controlling the velocity of the squeeze plate and the velocity of the pivoted squeeze plate independently, the squeezing process can be controlled such that the mould part can be positioned at the moulding chamber front at the end of the squeezing process.

The velocity of the squeeze plate and the pivoted squeeze plate may be controlled such that they move in the same direction during at least a part of the squeezing of the mould. The velocity of the squeeze plate and the pivoted squeeze plate may also be controlled such that either the squeeze plate or the pivoted squeeze plate is slowed down abruptly for creating a shock effect The velocity of the squeeze plate and the pivoted squeeze plate may also be controlled such that the pivoted squeeze plate is reversed during the squeezing operation. The velocity of the squeeze plate and the pivoted squeeze plate may also be controlled such that they move towards one another with different velocity during at least a part of the squeezing of the mould. The velocity of the squeeze plate and the velocity of the pivoted squeeze plate may be controlled according to a predetermined velocity versus time profile. The velocity of the pivoted squeeze plate is controlled such that the pivoted squeeze plate is positioned at the moulding chamber front at the end of the squeezing of the mould.

It is another object of the invention to provide a string moulding apparatus for producing mould parts of the kind referred to above, in which the bilateral squeezing process can be controlled in a better way.

By controlling the velocity of the squeeze plate and the velocity of the pivoted squeeze plate independently, the squeezing process can be controlled such that the mould part will be placed at the moulding chamber front at the end of the squeezing process.

According to an embodiment of the invention, the actuator driving the squeeze plate and the actuator driving the pivoted squeeze plate are independently powered. According to another embodiment of the invention a first hydraulic actuator driving the squeeze plate is powered by a first pump and a second hydraulic actuator driving pivoted squeeze plate is powered by a second pump. The apparatus may comprise a sensor for producing a signal corresponding to the velocity of the squeeze plate and comprising a sensor for producing a signal corresponding to the velocity of the pivoted squeeze plate. The apparatus may advantageously comprise a controller that receives the signals from the sensors and controls the velocity of the squeeze plate and the pivoted squeeze plate in response to these signals. In order to allow flexible operation of the apparatus, for example when shifting to another type of mould part, a number of operator selectable or automatically selectable predetermined velocity versus time profiles for the squeeze plate and the pivoted squeeze plate are stored in the controller. The controller may control the velocity of the squeeze plates in a closed loop manner for example according to a PID control function.

BRIEF DESCRIPTION OF THE DRAWINGS

In the following detailed part of the description, the invention will be explained in more detail with reference to the exemplary embodiments of the method of controlling the velocity of the squeeze plates of a string moulding apparatus during mould squeezing and a string moulding apparatus in which the velocity of the squeeze plates is controlled during squeezing of the mould part according to the invention shown in the drawings, in which FIGS. 1, 1*a*, 1*b*, 1*c*, 1*d* and 1*e* diagrammatically illustrate six stages during the production of a mould.

DETAILED DESCRIPTION OF THE INVENTION

Figure 2:
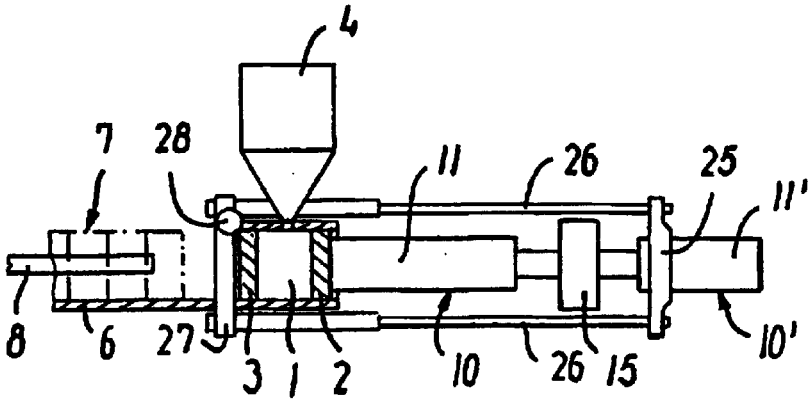
FIG. 2 shows a diagrammatic view of the guiding and actuating system of the apparatus.

In FIGS. 1, 1*a* to 1*e*, the six stages of the cycle of producing a mould in a string moulding apparatus are illustrated. In FIG. 1, a moulding chamber 1 is shown, of which one end is closed by a squeeze plate 2 carrying a pattern in its starting position, the other end being closed by a pivoted squeeze plate 3 carrying a pattern, in this Figure shown in its lowermost (starting) position. The moulding chamber 1 is filled with compressible mould material from a hopper. Usually green sand, i.e. clay bonded sand is a preferred moulding material. To the right side in this Figure are shown two previously produced moulds 5, resting and being conveyed stepwise on a conveyor 6, the top of which is aligned with the bottom of the moulding chamber 1.

FIG. 1*a* illustrates the bilateral pressing of a mould 5 in the moulding chamber by movement of the squeeze plate 2 into the moulding chamber 1 and movement of the pivoted squeeze plate 1 from the opposite side, viz. the chamber front 1*a*, into the moulding chamber 1 under influence of oppositely directed pressing forces, in this Figure being symbolised by arrows. The present invention relates specifically to the control of the velocity of the squeeze plates during this phase of the production cycle. The description of the rest the production cycle continues first. The details of the velocity control during the squeezing process follow thereafter.

FIG. 1*b* illustrates the situation, in which the pivoted squeeze plate 3 has been withdrawn from the moulding chamber 1 and pivoted upwardly in the direction shown by an arrow to a position, in which all of it is positioned at a level higher than the upper limiting level of the moulding chamber 1, thus allowing free passage below for the freshly pressed mould 5.

FIG. 1*c* illustrates the situation in which the mould 5 is being pushed out of the moulding chamber 1 by the squeeze plate 2 into abutment with the last of the previously produced moulds 5 and, according to a preferred embodiment, further until it occupies the position previously occupied by said previously produced mould, pushing the string of moulds generally designated with 7 one step towards the right in the Figure over a distance equal to the width of a mould 5 as measured in the longitudinal direction of the mould string 7. According to another embodiment, the squeeze plate 2 retracts when the mould 5 comes into abutment with the last of the previously produced moulds. The mould string is then transported by a mould-string-transporting means 8.

FIG. 1*d* illustrates the situation in which the squeeze plate 2 is moved back to its position as shown in FIG. 1 thereby stripping the squeeze plate 2 and an associated pattern from the mould 5.

FIG. 1*e* illustrates the situation in which moulding chamber is closed by the pivoted squeeze plate 3 having returned to the moulding chamber 1. Thus, both the squeeze plate 2 and the pivoted squeeze plate 3 have returned to their starting position. The two squeeze plates 2,3 automatically centre relatively to the sand injection slot 9, taking into account the height of the pattern plates carried by them. Consequently, wear caused to the pattern plates is reduced to a minimum, and the moulding chamber 1 can be homogeneously filled. The moulding chamber is charged again so that a new cycle may begin. During charging, the simultaneous movement of the squeeze plates towards one another may begin.

Between the moulds 5 casting cavities are formed, of which one is in the process of being cast with metal, whereas the two cavities to the extreme right in the Figures have already been cast with metal. During the further movement of the string of moulds 7, the metal in the casting cavities solidifies and finally, the moulds 5 with the solidified castings end up on a shake-out grate (not shown), on which the mould material is separated from the castings. Many moulds require the use of a core (not shown) which is inserted into the moulding cavity of the last produced mould part 5.

Figure 5:
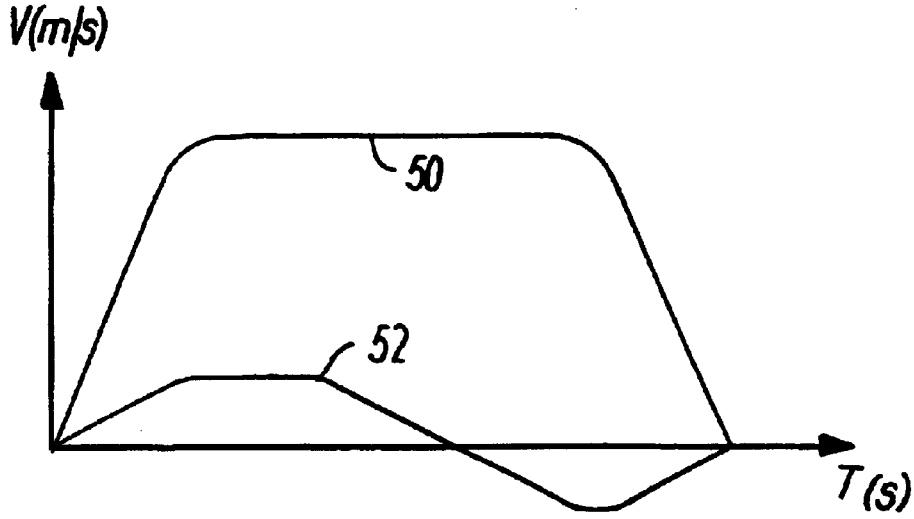
FIG. 5 shows a profile of the velocity of the squeeze plates versus time during squeezing of the mould part according to an embodiment of the invention.
Figure 5A:
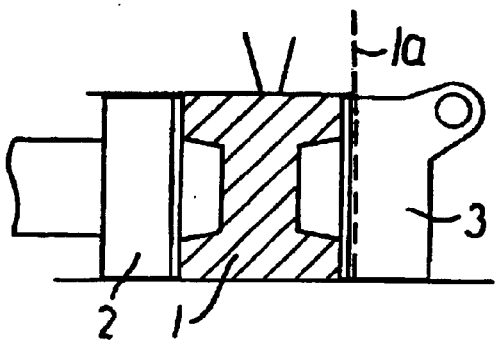
FIG. 5*a* shows the position of the squeeze plate and the pivoted squeeze plate at the beginning of the squeezing process.
Figure 5B:
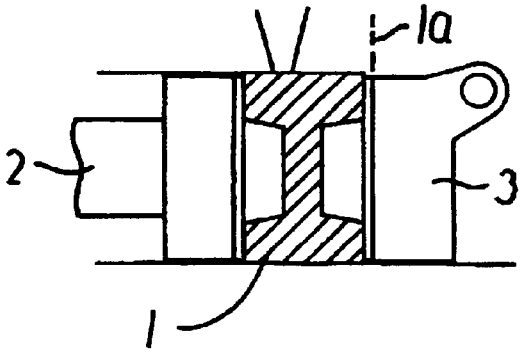
FIG. 5*b* shows the position of the squeeze plate and the pivoted squeeze plate at the end of the squeezing process.

FIG. 5 illustrates diagrammatically the velocity of the squeeze plate 2 and the pivoted squeeze plate 3 during the process of bilateral pressing of the mould part 5 in a first embodiment according to the invention. The starting position of the squeeze plates 2,3 is illustrated by FIG. 5*a*. During the squeezing process the speed of the squeeze is controlled according to the velocity versus time profile in FIG. 5, wherein the squeeze plate 2 continuously moves into the chamber moulding chamber 1, until it comes to a standstill, and the pivoted squeeze plate 3 starts off with a velocity smaller than that of the squeeze plate 2 and in a direction out of the moulding chamber 1, whereupon the pivoted squeeze plate 3 starts to slow down and reverses its direction and moves into the moulding chamber 1 towards the last part of the squeezing process, before it comes to a standstill at the end of the squeezing process. At the end of the squeezing process the squeeze plate 2 and the pivoted squeeze plate 3 are positioned as shown in FIG. 5*b*. Thus the pivoted squeeze plate 3 is positioned at the front 1*a* of the moulding chamber 1. The pivoted squeeze plate 3 can thus be stripped from the mould part 5 and retracted from the mould chamber 1 substantially without creating a vacuum. A vacuum created during the stripping off of the pivoted squeeze plate 3 could namely be detrimental to the surface quality of the mould part 5. During the first stage of the squeezing of the mould according to this embodiment the pressure on the squeeze plate side of the mould part 5 and the pressure on the pivoted squeeze plate side of the mould part 5 are not equal because of the friction between the mould material 4 and the moulding chamber 1 which is due to the relative movement of the mould material 4 with respect to the mould chamber 1. However at to the reversal of direction of the pivoted squeeze plate at the end of the squeezing process the relative speed between the mould part 5 and the moulding chamber is 0, and therefore the pressure acting on the mould part on the side of the pivoted squeeze plate is equal to the pressure acting on the side of the squeeze plate 2. The surface quality of the two sides of the mould part is therefore equal.

Figure 6:
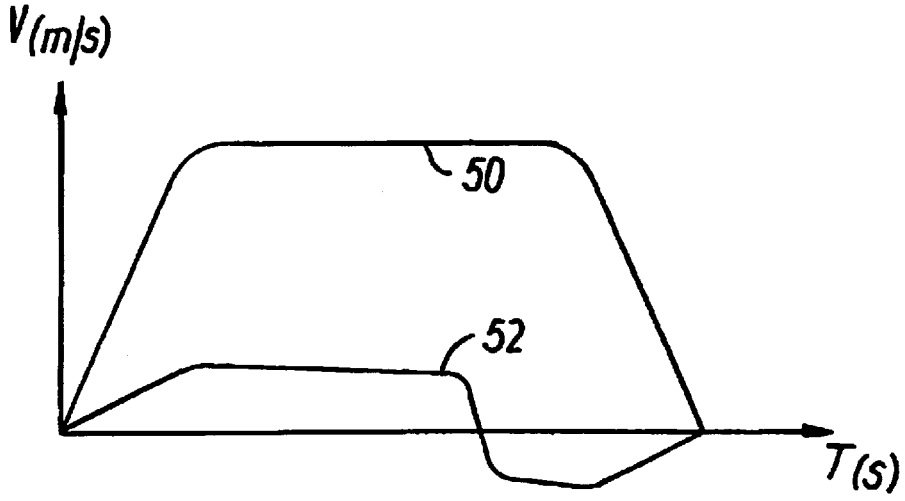
FIG. 6, shows a profile of the velocity of the squeeze plates versus time during squeezing of the mould part according to another embodiment of the invention.
Figure 6A:
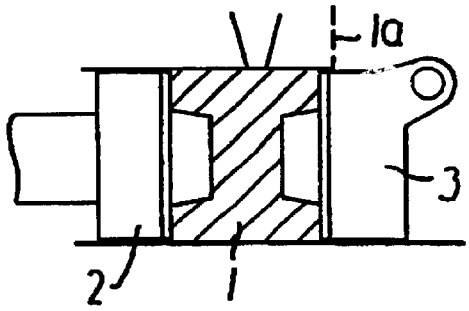
FIG. 6*a* shows the position of the squeeze plate and the pivoted squeeze plate at the beginning of the squeezing process corresponding to FIG. 6.
Figure 6B:
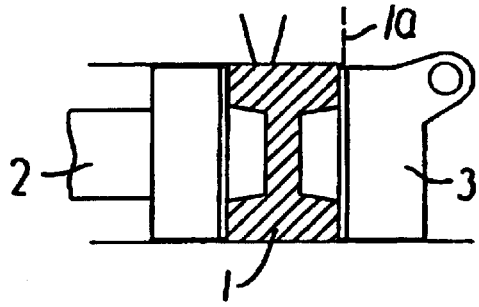
FIG. 6*b* shows the position of the squeeze plate and the pivoted squeeze plate at the end of the squeezing process corresponding to FIG. 6.

FIG. 6 illustrates diagrammatically the velocity versus time profile according to a further embodiment of the invention. The starting position of the squeeze plates 2,3 is illustrated by FIG. 6*a*. During the squeezing process the speed of the squeeze is controlled according to the velocity versus time profile in FIG. 6, wherein the squeeze plate 2 continuously moves into the chamber moulding chamber 1, until it comes to a standstill, and the pivoted squeeze plate 3 starts off with a velocity smaller than that of the squeeze plate 2 and in a direction out of the moulding chamber 1, whereupon the pivoted squeeze plate 3 abruptly slows down and reverses its direction and moves into the moulding chamber 1 towards the last part of the squeezing process, before it comes to a standstill at the end of the squeezing process. The pivoted squeeze plate 3 may also start off with the same velocity as the squeeze plate 3 (not shown). At the end of the squeezing process the squeeze plate 2 and the pivoted squeeze plate 3 are positioned as shown in FIG. 6*b*. Due to the abrupt slowing down of the pivoted squeeze plate 3 during the process of squeezing the mould part 5 a chock effect is created which improves the compacting of the particulate mould material 4.

Figure 7:
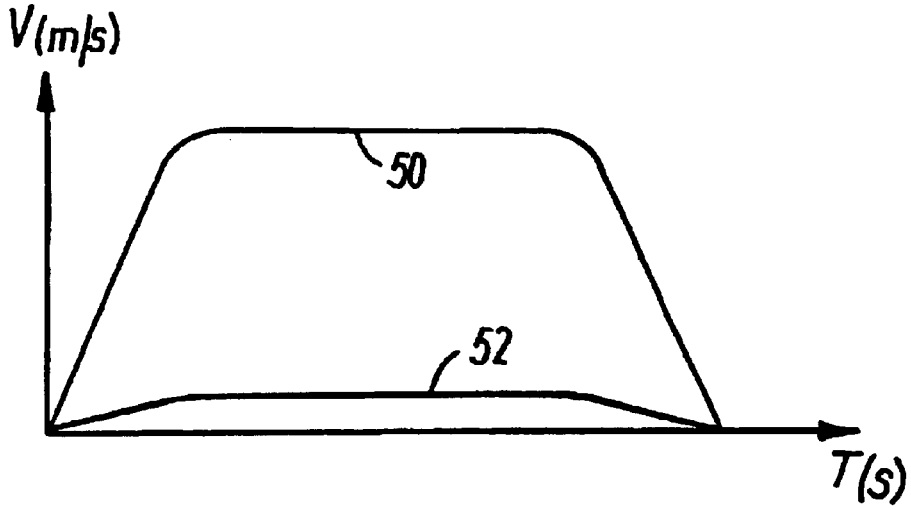
FIG. 7 shows a profile of the velocity of the squeeze plates versus time during squeezing of the mould part according to an yet another embodiment of the invention.
Figure 7A:
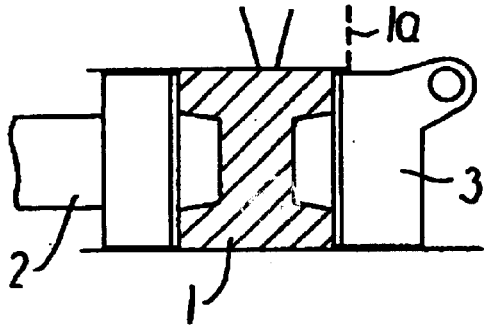
FIG. 7*a* shows the position of the squeeze plate and the pivoted squeeze plate at the beginning of the squeezing process corresponding to FIG. 7.
Figure 7B:
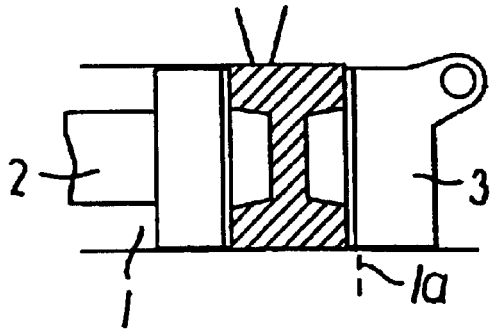
FIG. 7*b* shows the position of the squeeze plate and the pivoted squeeze plate at the end of the squeezing process corresponding to FIG. 7.

FIG. 7 illustrates diagrammatically the velocity versus time profile another embodiment of the invention. The starting position of the squeeze plates 2,3 is illustrated by FIG. 7*a*. During the squeezing process the speed of the squeeze is controlled according to the velocity versus time profile in FIG. 7, wherein the squeeze plate 2 continuously moves into the chamber moulding chamber 1, until it comes to a standstill, and the pivoted squeeze plate 3 starts off with a velocity smaller than that of the squeeze plate 2 and in a direction out of the moulding chamber 1, and both squeeze plates come is a standstill at the end of the squeezing process. At the end of the squeezing process the squeeze plate 2 and the pivoted squeeze plate 3 are positioned as shown in FIG. 7*b*. Thus the pivoted squeeze plate 3 is positioned at the front 1*a* of the moulding chamber 1. The pivoted squeeze plate 3 can thus be stripped from the mould part 5 and retracted from the mould chamber 1 without creating a vacuum.

During the of the squeezing of the mould part 5 according to this embodiment the pressure on the squeeze plate side of the mould part 5 and the pressure on the pivoted squeeze plate side of the mould part 5 are not equal because of the friction between the mould material 4 and the moulding chamber 1 which is due to the relative movement of the mould material 4 with respect to the mould chamber 1. In this embodiment different degrees in compaction of the moulding material, and hence also difference in the degree of hardness of the mould part surface have to be accepted.

Figure 3:
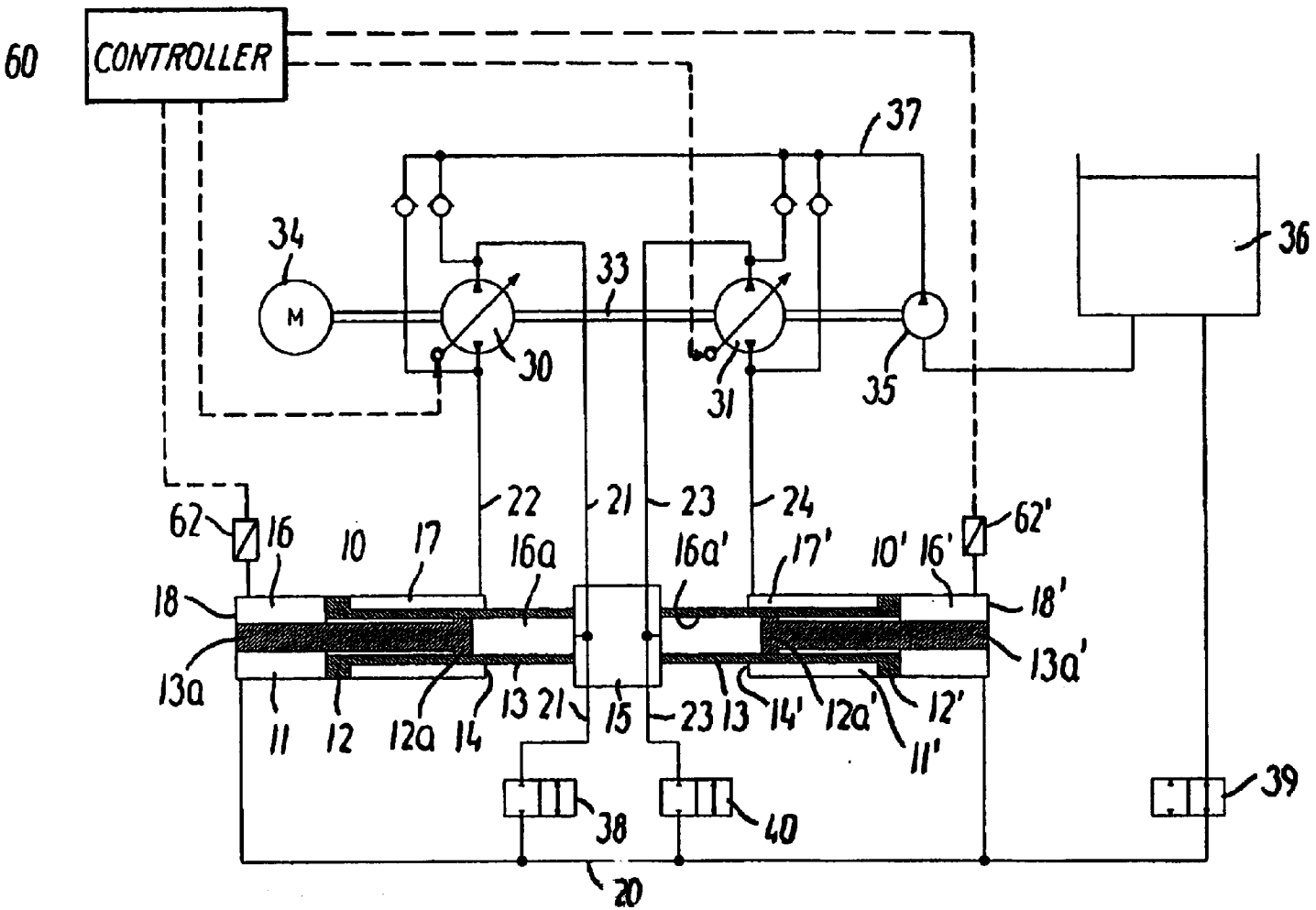
FIG. 3 shows a circuit diagram of the hydraulic system for the apparatus.

FIGS. 2 and 3 illustrate diagrammatically the construction of the string moulding apparatus. The movement of the pressure plate 2 is derived from a linear hydraulic actuator 10 comprising a cylinder member 11, to which the squeeze plate 2 is directly secured, and a piston member comprising a piston head 12 and a piston rod 13 that passes tightly through an inner end wall 14 of the cylinder 11 and is supported by a stationary block 15. The stationary block 15 is an integral part of the base frame of the apparatus. The piston member divides the cylinder chamber into an outer annular compartment 16 and an inner annular compartment 17. The piston rod 13 is hollow and defines an inner annular chamber. A second piston rod 13*a* extends from the outer end wall 18 of the cylinder 11 into the outer annular chamber 16. A second piston head 12*a* secured to the free end of the second piston rod 13*a* fits tightly in the annular chamber, thereby defining a compartment 16*a*. The compartments 16, 16*a* and 17 are connected to conduits 20. 21 and 22 for supply and discharge of pressure fluid. The cylinder member 11 actually constitutes the movable element.

The pivoted pressure plate 3 comprises an analogous linear hydraulic actuator 10' with a cylinder member 11', a piston head 12', a hollow piston rod 13', also supported by the block 15, an inner end wall 14', an outer compartment 16', an inner annular compartment 17', a second piston rod 13*a'*, an outer end wall 18', a second piston head 12', a compartment 16*a'* and conduits 20, 23 and 24.

Also in this case, it is actually the cylinder member 11' that constitutes the movable element and this cylinder member 11' is connected to the pivoted pressure plate 3 through a bracket 25 secured to the cylinder 11' at the inner end thereof, said bracket 25 being connected through push and pull rods 26 with a frame 27 supporting the pivoted squeeze plate 3 in a hinge 28. The pivoting movement about the hinge pivoted squeeze plate 3 is caused by a lever device (not shown) forcing the pivoted squeeze plate 3 to pivot upwardly when the frame 27 is moving away from the moulding chamber 1 and vice versa. When moving away from the moulding chamber 1, the pivoting movement does not start before the pivoted squeeze plate 3 has reached a minimum distance that equals at least the height of its associated pattern from the moulding chamber.

As shown in FIG. 3, the hydraulic system of the mould string apparatus comprises a first and second variable displacement hydraulic pumps 30 and 31. The pumps 30,31 are double-sided, i.e. they can deliver and receive fluid in two directions and therefore the pumps can be connected in closed circuit. In this embodiment the pumps 30,31 are swashplate pumps having a swash-plate serving as a displacement volume varying member. The pump driving the actuator 10 associated with the squeeze plate 2 has preferably a larger capacity than the other pump, since the squeeze plate 2 is required to move at higher speed than the pivoted squeeze plate 3. A booster pump 35 delivers hydraulic fluid from a reservoir 36 to the pumps 30,31 through a conduit 37. The pumps 30,31 and 35 are coupled to a common drive shaft 33 that is driven by a motor 34. Thus, the breaking energy fed back to one of the pumps is transmitted to the other pump.

Each of the two ports of the first pump 30 is connected to the conduit 37 via a separate conduit including a non-return valve. In an analogous manner, each of the ports of the second pump 31 is connected to conduit 37.

One of the ports of the first pump 30 is connected to the inner compartment 17 of the fist linear hydraulic actuator 10.

The other port is connected directly through conduit 21 to compartment 16*a* and further via an on/off valve 38 and through a common conduit 20 to the outer compartment 16 of the first linear hydraulic actuator 10. The conduit 20 is connected via an on/off valve 39 to the reservoir.

In an analogous manner, one of the ports of the second pump 31 is connected to the inner compartment 17' of the second linear hydraulic actuator 10'. The other port is connected directly though conduit 24 to compartment 16*a*' and further via an on/off valve 40 and through a common conduit 20 to the outer compartment 16' of the second linear hydraulic actuator 10'.

The operation of the hydraulic system during the various stages of the production cycle of the string moulding apparatus will now be described.

A controller 60 controls the operation of the production cycle. This controller can be of any known type, such as a numerical logic control or a digital computer, such as a PC.

For bilateral pressing the mould (FIG. 1*a*), valves 38 and 40 are in the "on", i.e. the open position and valve 39 is in the "off" position. The direction of the pumps 30,31 is set to deliver the fluid under pressure to the ports that are connected to the conduits 21 and 23, respectively. Fluid under pressure is thus delivered to the compartments 16*a* and 16*a*' and through the open valves 38 and 40 to the outer compartments 16 and 16'. The inner compartments 17 and 17' are connected through conduits 22 and 24 to the suction side of the first pump 30 and the second pump 31, respectively. Since the volume of compartments 17 and 17' returning fluid is smaller than that of the compartments receiving fluid, additional fluid is drawn in by the pumps 30,31 from the reservoir 36 and delivered by the booster pump 35 via the non-return valves. A maximum force on the squeeze plates 2 and 3, for pressing the mould 5 in the chamber 1, is thus obtained.

The velocity of the actuator 10 is measured by a sensor 62 that gives a signal to the controller 60. The velocity may also be measured by using a position sensor and differentiating the signal to time. The velocity of the actuator 11 is measured by a sensor 62' that gives a signal to the controller 60. The velocity of the actuators 10, 11 corresponds directly to the velocity of the squeeze plate 2 and the pivoted squeeze plate 3, respectively. Consequently, the controller 60 can monitor the velocities of the squeeze plates 2,3. The controller 60 is connected to the pumps 30 and 31, and a signal from the controller sets the output rate of the respective variable displacement pump. A set of velocity versus time profiles for the squeeze plate 2 and the pivoted squeeze plate 3 as shown in FIGS. 5 to 7 is stored in the controller 60. The controller 60 compares the measured velocity with the desired velocity according to the selected profile and sends out a signal to each of the pumps 30 and 31 to obtain the desired velocity in a closed loop-manner. The closed loop-control may be proportional, integral, differential or combinations thereof as well-known from industrial PID controllers.

For stripping the pivoted squeeze plate 3 from the mould 5 and for pivoting the pivoted squeeze plate 3 out of the way, the direction of pump 31 is set to deliver fluid under pressure to the port that is connected to conduit 24. Pressurised fluid is thus delivered to chamber 17'. In order to evacuate compartment 16', valve 39 is switched to the "on" position and the fluid is returned via the open valve 39 through the conduit 20 to the reservoir 36. The fluid evacuating from compartment 16*a*' is returned to the pump through conduit 23, since the valve 40 is switched in the "off" position.

For pushing the mould 5 out of the moulding chamber 1 with the squeeze plate 2 (FIG. 1*c*), the pump 30 is set to deliver fluid under pressure to the port that is connected to the conduit 21. Valve 38 is switched to its "off" position, thus only chamber 16*a* is pressurised. The fluid evacuating from chamber 17 is returned through conduit 22 to the pump 30.

For stripping-off the squeeze plate 2 from the mould 5 and for moving the squeeze plate 2 back to its starting position (FIG. 1*d*), pump 30 is switched to deliver fluid under pressure to the port connected to conduit 22. Thus, compartment 17 is pressurised. The fluid evacuating from chamber 16*a* is returned to the pump 30 through conduit 21, the valve 38 is switched to the "off" position. The fluid evacuating from the compartment 16 is returned through conduit 20 via the open valve 39 to the reservoir 36.

For returning the pivoted squeeze plate 3 to the moulding chamber 1 (FIG. 1*e*), the pump 31 is set to deliver fluid under pressure to the port connected to conduit 23. Valve 40 is switched to its "off" position, thus only chamber 16*a*' is pressurised. The fluid evacuating from chamber 17' is returned through conduit 24 to the pump 31.

Figure 4:
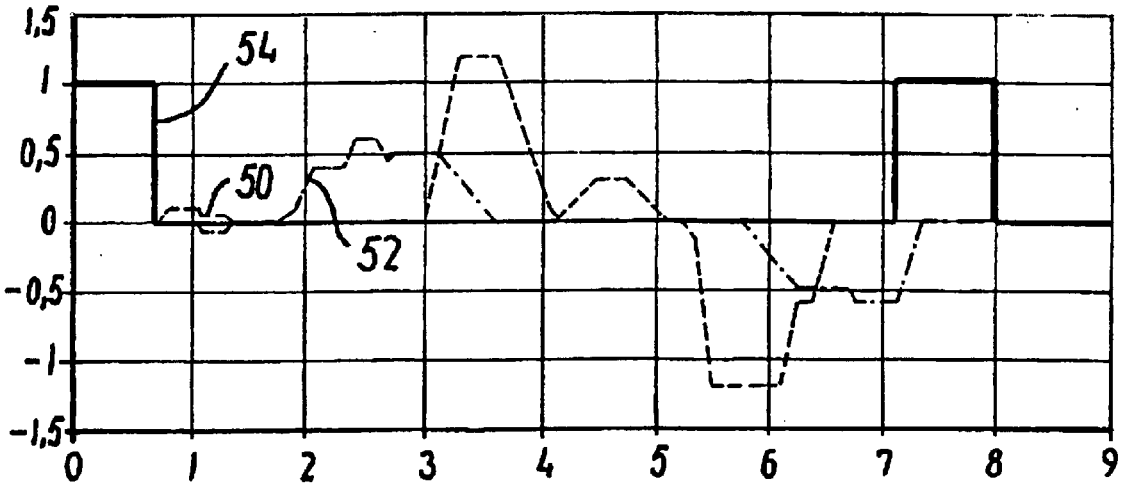
FIG. 4 shows is a plot of the velocity of the squeeze plates versus time, i.e. a velocity profile, of the complete production cycle.

With reference to FIG. 4 the movements of the pressure plates 2 and 3 are illustrated by means of a profile of the speed in m/s versus time in seconds. The line with reference numeral 50 represents the speed of the squeeze plate 2. The line with reference numeral 52 represents the speed of the pivoted squeeze plate 3, whereas the line with reference numeral 54 indicates the time in which the sand is shot into the moulding chamber 1.

After the sand shot, the bilateral squeezing of the mould 5 is initiated by the squeeze plate 2. The start of the pressing movement of the pivoted squeeze plate can, as explained in more detail in U.S. Pat. No. 5,647,424, be delayed with respect to the squeeze plate 2 in order to compensate for the limited stroke of the pivoted squeeze plate 3. In apparatus with an extended stroke of the pivoted squeeze plate 3, the pressing movement of the squeeze plates 2,3 can commence simultaneously. Next, the pivoted squeeze plate 3 is stripped off the mould 5 and pivoted out of the way. Before this movement of the pivoted squeeze 3 plate has finished, the squeeze plate 2 starts to move further Into and past the moulding chamber 1 to push out the mould 5. This movement is however preferably not started before the pivoted squeeze plate 3 and its associated pattern have passed the front of the moulding chamber 1. The squeeze plate 2 continues it movement to push the mould 5 beyond the pivoted squeeze plate 2 and slows down to a complete standstill when the front of the mould 5 abuts with the previously produced mould 5. The movement of the squeeze plate 2 is thereafter continued so that the last and previously produced moulds are moved together as a stack or string 7 of moulds 5. When movement of the mould string 7 is completed, the movement of the squeeze plate 2 is reversed to move back to the starting position. Before the squeeze plate 2 has reached its starting position, the pivoted squeeze plate 3 starts to pivot and move back to the moulding chamber 1. The timing of time movement of the pivoted squeeze plate 3 back to the moulding chamber 1 is calculated taking into account the geometry and position versus time of the pivoted squeeze plate 3, the geometry and the position versus time of the squeeze plate 2 and the associated patterns. Before the pivoted squeeze plate 3 has reached its starting position again, in which it closes the moulding chamber 1, the sand shot is started, and a new cycle begins.

According to an embodiment of the invention, the centering of the two squeeze plates is done simultaneously.

According to an embodiment of the invention, the velocity of the squeeze plate and the velocity of the pivoted squeeze plate can be such that the squeeze plate and the pivoted squeeze plate move towards one another with equal velocity during at least a part of the squeezing step.

According to an embodiment of the invention, the pumps 30, 31 are fixed displacement pumps. In this embodiment, either the speed at which the pumps are driven is varied or proportional valves are used in order to vary the amount of fluid delivered to the actuators.

LIST OF REFERENCE NUMERALS

1 moulding chamber
1*a* moulding chamber front
2 squeeze plate
3 pivoted squeeze plate
4 moulding material
5 mould part
6 conveyor
7 mould string
8 mould-string-transporting means
9 sand injection slot
10 first linear hydraulic actuator
10' second linear hydraulic actuator
11 cylinder
11' cylinder
12 piston head
12' piston head
12*a* second piston head
12*a'* second piston head
13 piston rod
13' piston rod
13*a* second piston rod
13*a'* second piston rod
14 inner end wall
14' inner end wall
15 stationary block
16 outer annular compartment
16' outer annular compartment
16*a* compartment
16*a'* compartment
17 inner annular compartment
17' inner annular compartment
18 outer end wall
18' outer end wall
20 conduit
21 conduit
22 conduit
23 conduit
24 conduit
25 bracket
26 push and pull rods
27 frame
28 hinge
30 first pump
31 second pump
33 common drive shaft
34 motor
35 booster pump
36 reservoir
37 conduit
38 on/off valve
39 on/off valve
40 on/off valve
50 velocity of squeeze plate
52 velocity of pivoted squeeze plate
54 sand shot
60 controller
62 velocity sensor
62' velocity sensor

What is claimed is:

1. Method of producing mould parts on a string moulding apparatus, the apparatus comprising a moulding chamber between a squeeze plate and a pivoted squeeze plate in which both the squeezes plate and the pivoted squeeze plate can move in a direction towards each other and in a direction away from one another, said method comprising the steps of:

introducing a compressible particulate moulding material in the moulding chamber and squeezing the moulding material by moving the squeeze plate and the pivoted squeeze plate towards one another to form a mould part, said squeezing step including the steps of sensing a velocity of the movement of the squeeze plate and a velocity of the movement of the pivoted squeeze plate to generate signals; feeding said signals to a controller; and controlling a variable velocity of the movement of the squeeze plate and a variable velocity of the movement of the pivoted squeeze plate independent from one another during the squeezing step.

2. Method according to claim 1, wherein said controlling step controls the variable velocity of the squeeze plate and the variable velocity of the pivoted squeeze plate such that the squeeze plate and the pivoted squeeze plate move in a same direction during at least a part of the squeezing step.

3. Method according to claim 2, wherein said controlling step controls the variable velocity of the squeeze plate and the variable velocity of the pivoted squeeze plate such that either the squeeze plate or the pivoted squeeze pate is slowed down abruptly for creating a shock effect.

4. Method according to claim 2, wherein said controlling step controls the variable velocity of the squeeze plate and the variable velocity of the pivoted squeeze plate such that the pivoted squeeze plate is reversed during the squeezing step.

5. Method according to claim 2, wherein said controlling step controls the variable velocity of the squeeze plate and the variable velocity of the pivoted squeeze plate such that the squeeze plate and the pivoted squeeze plate move towards one another with different velocities during at least a part of the squeezing step.

6. Method according to claim 1, wherein said controlling step controls the variable velocity of the squeeze plate and the variable velocity of the pivoted squeeze plate such that the squeeze plate and the pivoted squeeze plate move towards one another with equal velocity during at least a part of the squeezing step.

7. Method according to claim 1, wherein the variable velocity of the squeeze plate and the variable velocity of the pivoted squeeze plate are controlled according to a predetermined velocity versus time profile.

8. Method according to claim 1, wherein the moulding chamber includes a front into which the pivoted squeeze plate is introduced, and wherein the variable velocity of the pivoted squeeze plate is controlled such that the pivoted squeeze plate is positioned at the moulding chamber front at the end of the squeezing step.

9. String moulding apparatus for producing mould parts comprising:

a squeeze plate and an associated pivoted squeeze plate between which a moulding chamber is defined and in which moulding chamber mould parts are produced by introducing a compressible particulate moulding material in the moulding chamber, and a moving means for moving the squeeze plate and the pivoted squeeze plate towards each other to squeeze the compressible particulate material in the moulding chamber into the mould part velocity sensing means for sensing a velocity of the movement of the squeeze plate and a velocity of the movement of the pivoted squeeze plate; and a controller which controls said moving means in response to signals from the velocity sensing means so that a variable velocity of the squeeze plate and a variable velocity of the pivoted squeeze plate are controlled independently from one another as said moving means moves the squeeze plate and pivoted squeeze plate to form the mould part.

10. Apparatus according to claim 9, wherein said moving means includes a first actuator driving the squeeze plate and a second actuator driving the pivoted squeeze plate which said first and second actuators are independently powered.

11. Apparatus according to claim 9, wherein said moving means includes a first hydraulic actuator driving the squeeze plate which is powered by a first pump, and a second hydraulic actuator driving the pivoted squeeze plate which is powered by a second pump.

12. Apparatus according to claim 10, further comprising a first sensor for producing a signal corresponding to the velocity of the squeeze plate, and a second sensor for producing a signal corresponding to the velocity of the pivoted squeeze plate.

13. Apparatus according to claim 12, wherein said controller receives the signals from the first and second sensors and controls the variable velocity of the squeeze plate and the pivoted squeeze plate in response to these signals.

14. Apparatus according to claim 13, further including a number of operator selectable or automatically selectable predetermined velocity versus time profiles for the squeeze plate and the pivoted squeeze plate which are stored in the controller.

15. Apparatus according to claim 14, wherein the controller controls the speed of the squeeze plate and the pivoted squeeze plate during the squeezing of the mould according to one of the speed versus time profiles stored in the controller.

16. Apparatus according to claim 11, wherein the first pump and the second pump are variable displacement pumps, whereby displacements of the first pump and the second pump are set according to a respective signal from the controller.

17. Apparatus according to claim 11, further comprising a first sensor for producing a signal corresponding to the velocity of the squeeze plate, and a second sensor for producing a signal corresponding to the velocity of the pivoted squeeze plate.

18. Apparatus according to claim 17, wherein the controller, the first sensor, the first pump and the first actuator form a closed loop PID control system.

19. Apparatus according to claim 17, characterized in that the controller, the second sensor, the second pump and the second actuator form a closed loop PID control system.

* * * * *